United States Patent [19]

Stahl

[11] Patent Number: 5,035,326

[45] Date of Patent: Jul. 30, 1991

[54] MULTI-LEVEL BASKET

[75] Inventor: Edward L. Stahl, Lee's Summit, Mo.

[73] Assignee: Piper Industries of Texas, Inc., Orlando, Fla.

[21] Appl. No.: 402,684

[22] Filed: Sep. 5, 1989

[51] Int. Cl.[5] ..... B65D 21/04

[52] U.S. Cl. ..... 206/507; 206/511; 206/512; 206/505

[58] Field of Search ..... 206/507, 505, 503

[56] References Cited

U.S. PATENT DOCUMENTS

| | | | |
|---|---|---|---|
| 3,387,740 | 6/1968 | Bockenstette | 206/505 |
| 3,392,875 | 7/1968 | Bockenstette . | |
| 3,420,402 | 1/1969 | Frater et al. . | |
| 4,093,070 | 6/1978 | Stahl | 206/507 |
| 4,106,623 | 8/1978 | Carroll | 206/507 |
| 4,106,624 | 8/1978 | Thurman | 206/507 |
| 4,106,625 | 8/1978 | Carroll | 206/507 |
| 4,189,052 | 2/1980 | Carroll et al. . | |
| 4,211,327 | 7/1980 | Stahl | 206/505 |
| 4,320,837 | 3/1982 | Carroll | 206/507 |
| 4,426,001 | 1/1984 | Stahl et al. . | |
| 4,440,302 | 4/1984 | Ehrman | 206/507 |
| 4,520,928 | 6/1985 | Wilson | 206/507 |
| 4,523,681 | 6/1985 | Kreeger | 206/507 |
| 4,600,103 | 7/1986 | Tabler | 206/507 |
| 4,601,393 | 7/1986 | Veenman | 206/507 |
| 4,619,366 | 10/1986 | Kreeger . | |
| 4,621,670 | 11/1986 | Yuen | 206/459 |
| 4,643,310 | 2/1987 | Deaton | 206/506 |
| 4,759,451 | 7/1988 | Apps | 206/507 |

FOREIGN PATENT DOCUMENTS 147115 of 1959 Sweden .

*Primary Examiner*—Stephen Marcus
*Assistant Examiner*—S. Castellano
*Attorney, Agent, or Firm*—Hovey, Williams, Timmons & Collins

[57] ABSTRACT

An improved multi-level basket especially useful in storing and transporting baked goods is provided which enables similarly configured baskets to be oriented for stacking at three different levels. The multi-level basket hereof offers enhanced strength and stability by the raised rim and lowered base which protect the stacking and nesting members from wear or breakage during use. Complimentary baskets are vertically stacked or nested by placement of the baskets in superposed registry. The baskets are advantageously provided with lugs on their front wall for resisting lateral movement of stacked baskets constructed in accordance with the invention hereof.

2 Claims, 5 Drawing Sheets

MULTI-LEVEL BASKET

BACKGROUND OF THE INVENTION

1. Field of the Invention

This invention relates to a basket particularly adapted for stacking on a similarly configured basket whereby the baskets may be placed in either a stacked, nested, or alternately a storage orientation. The invention hereof is especially concerned with a basket of rugged construction designed to withstand the abuse and wear of a commercial bakery by the inclusion of a raised rim which protects the stacking components, and a stacking lug for limiting lateral movement of the basket in a stacked or nested orientation.

2. Description of the Prior Art

As is well known, commercial bakeries may produce a variety of different products having different heights or configurations. These baked goods are relatively soft and delicate, and must be protected from smashing caused by loading heavy objects thereon. As a result, bakery baskets have been developed whereby a number of different baskets may be stacked to present an integrated group of baskets. These stacked baskets thus protect the baked goods from compression and enable the "stack" to be moved as a unit to a bakery truck for delivery to the retail store.

Because of storage considerations, it has been desirable to have baskets which will stack at two or more different levels. For example, in one orientation, the baskets may be stacked to protect the baked goods carried in the lower basket while enabling the baskets to be shifted relative to one another for positioning in a storage orientation. Baskets exemplifying this concept are shown, for example, in U.S. Pat. Nos. 3,420,402, 4,426,001 and 4,619,366.

However, the need has arisen for a basket which will stack at three different levels. Because a bakery may put out a variety of different products, such as bread (which, as baked, rises to one height), and hamburger buns (which are grouped in packages having a second, lower height), as well as a third position for storing the baskets after the products have been dispensed from the basket. One example of a basket embodying this particular characteristic is shown in U.S. Pat. No. 4,189,052.

While each of these baskets has demonstrated the capacity for nesting and stacking, it has been found that they expose the various stacking lips and lugs to abuse and wear in the ordinary environment. For example, each of these prior art devices includes projections, lips or lugs which extend either above or below the surrounding portions of the basket, making these projections subject to wear as the basket skids across the bakery floor, is dropped, or is otherwise subject to the hazards inherent in an industrial environment. As a result of breakage and wear, these baskets soon become unusable in that the projections or lugs break off and prevent the baskets from forming a stable stack. In addition, the baskets of the prior art have lacked sufficient stacking and stabilizing members adjacent the front and rear endwalls for vertical stacking and ensuring the baskets are prevented from excessive lateral shifting.

A need has also been felt for a basket which includes a means of identifying the freshness of the product contained therein. When trays or products are delivered to a restaurant or retail outlet, it is frequently difficult to determine the date of delivery and thus the useful shelf life of the product by visual inspection of the product itself. Yet further, as numerous shifts may go on and off during the course of several days, it is difficult to identify which baskets were delivered when, and thus the retail outlet or restaurant may have difficulty, even when keeping track of the invoices or delivery schedules, of which products are fresh to prevent stale products from being provided to the customer.

Yet further, a need has arisen for a multi-level basket which will readily aid a baker or deliveryman in ascertaining the orientation of the basket in a stacked, nested or storage position. Such baskets are conventionally uniform in color and not quickly distinguishable as to which level they are presently oriented.

SUMMARY OF THE INVENTION

The problems outlined above are in large measure solved by the multi-level basket of the present invention which is rugged, sturdy, and may be formed as a unitary synthetic resin member which will stack at three different levels for use with different products or for storage.

The basket in accordance with the present invention broadly includes a floor, a front and a rear endwall, and two opposed sidewalls. The sidewalls are essentially opposed, mirror images of each other and include a plurality of interconnected stacking posts. The stacking posts are spaced at intervals along the sidewall to present nesting ledges therebetween.

The stacking posts include stacking platforms and stacking feet, the stacking feet being of complimentary configuration to the nesting ledge and the stacking platform. Thus, the basket hereof may be stacked at a first, higher elevation by positioning the stacking feet of a basket on the stacking platform of a second basket of similar configuration; or nested at a second, lower elevation by shifting one of the baskets 180 degrees whereby the stacking feet of the first, uppermost basket are positioned on the nesting ledges of the lower basket. The sidewalls are provided with an upwardly extending rim for protecting the stacking lips from damage during use. In addition, the front endwall includes a stacking lug and a stacking toe for reinforcing the basket and limiting transverse movement of the basket in a stacked or nested configuration.

In particularly preferred forms, the basket hereof includes a rear endwall which is provided with a nesting shelf for receiving the stacking toe of a similar basket when the baskets are shifted into a nesting orientation. The complimentary stacking toe and nesting shelf provide additional strength to a stack of nested baskets and inhibit lateral movement of the baskets nested therein. In such nested orientation, a portion of the front and rear endwalls of the upper basket adjacent the respective sidewalls are located inwardly relative to the rear and front endwalls, respectively, of the lower basket.

Advantageously, the basket hereof includes a base projecting downwardly from the floor adjacent the sidewalls. The base projects lower than the stacking feet opposite the base, to protect the stacking feet from damage and wear occasioned by such rough usage as i the basket along a bakery floor. A space is defined between the base and the stacking feet stacking lips or nesting lips, according orientation of a lower basket, may fit within the space of the upper basket.

As mentioned hereinabove, the present invention concerns a basket which may be oriented in three separate positions. In preferred forms, the basket includes a number of slits for receiving an insert of a contrasting color to differentiate the front and rear endwalls. By consistently marking the front endwall or the rear endwall with an insert, the user may readily identify whether the baskets are in a stacked, nested or storage orientation.

In particularly preferred forms, the basket hereof includes integrally formed indicia in one or both sidewalls for enabling the user to identify the expiration date of the baked product therewithin. The indicia are arranged in two rows out of registry with the first row corresponding to the date of delivery and the second row corresponding to the expiration date beyond which the baked product should not be distributed. By simply making one vertical mark with a piece of chalk, the bakery deliveryman can simultaneously indicate both the day of delivery and the product expiration day. The indicia preferably correspond to different days of the week.

DESCRIPTION OF THE PREFERRED EMBODIMENT

Figure 1:
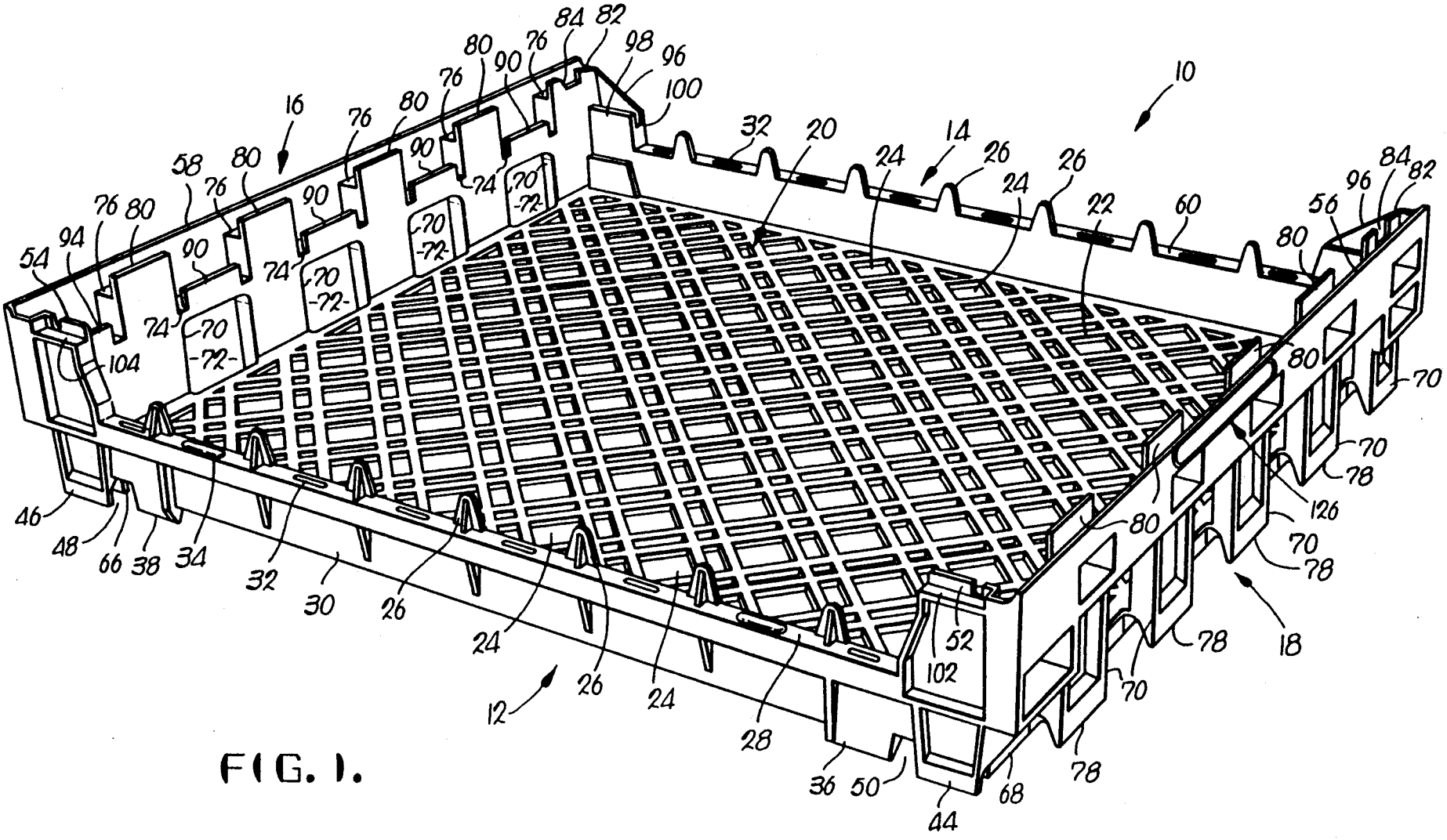
FIG. 1 is a top perspective view of a multi-level basket in accordance with the present invention.

Referring now to the drawing, a multi-level basket 10 broadly includes a front endwall 12, a rear endwall 14, a left sidewall 16, a right sidewall 18 and a floor 20. The left sidewall 16 and right sidewall 18 are substantially mirror images of one another, whereby similar baskets may be placed on basket 10 in different orientations to enable stacking or nesting at a plurality of levels. The basket 10 hereof may advantageously be constructed by injection molding whereby the entire basket 10 may be formed as a unitary article from a synthetic resin such as polyethylene.

In greater detail, floor 20 includes a series of selectively spaced ribs 22 to define uniformly spaced openings 24 therebetween. The openings 24 are spaced at preselected intervals which correspond to the spacing of teeth 26 projecting upwardly from the front endwall 12 and the rear endwall 14 for inhibiting spillage of baked product from the basket 10 and interfitting through the floor 20 of a similary configured basket when in a storage orientation.

Front endwall 12 includes a cornice 28 of somewhat greater width than wall portion 30. Cornice 28 is provided with a plurality of spaced slits 32 for receiving therein in insert 34, preferably of a contrasting color to the remainder of multi-level basket 10 for use as a marker in visually identifying which portion of the basket is the front. The insert preferably is of a snaplock type having an outwardly projecting jaws which yield as the insert is pressed into slit 32. As the insert 34 is fully seated, the jaws spring outwardly to their normal position and thus lock the insert 34 in position. Rear endwall 14 is similarly provided with a plurality of slits 32 therein in the event it is desired to insert markers 34 in the rear endwall rather than the front endwall. Preferably, the insert 34 would be formed of a light colored resilient synthetic resin such as polyethylene when the basket 10 is formed of a brown or black synthetic resin.

Figure 4:
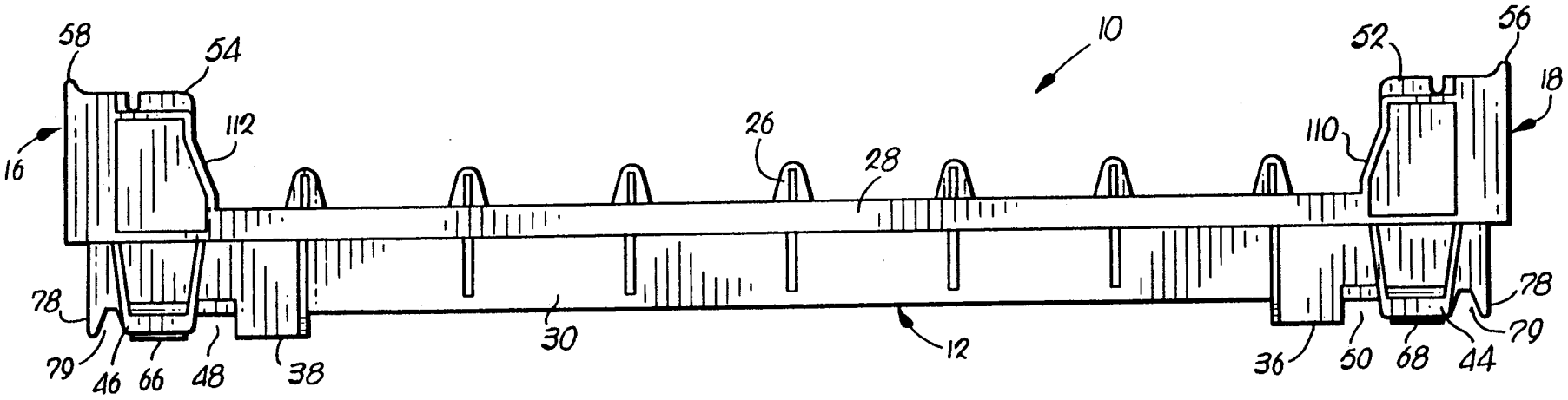
FIG. 4 is a front elevation view of the multi-level basket shown in FIG. 1.
Figure 5:
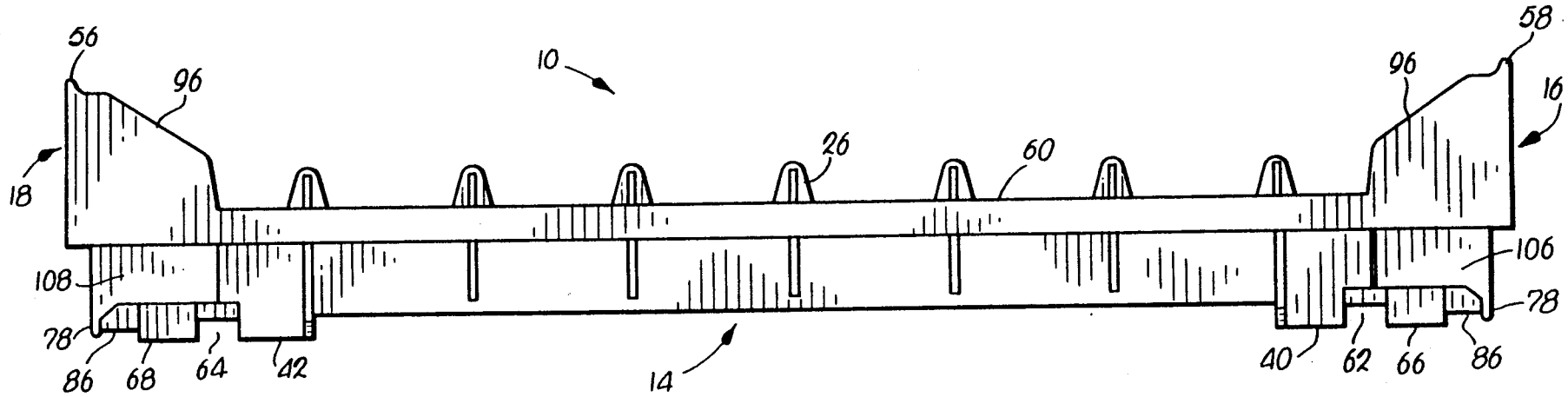
FIG. 5 is a rear elevation view of the multi-level basket shown in FIG. 1.

As better seen in FIGS. 4 and 5, front endwall 12 and rear endwall 14 each include a plurality of downwardly extending registry legs 36, 38, 40 and 42. Referring to FIG. 4, front endwall 12 also includes stacking toes 44 and 46. As may be seen from FIG. 4, both registry legs 36 and 38 and stacking toes 44 and 46 project downwardly with respect to the remainder of front endwall 12 to define a recess 48 and a recess 50 between registry leg 38 and stacking toe 46 and registry leg 36 and stacking toe 44, respectively. Stacking toes 44 and 46 are each oriented normally below their respective stacking lugs 52 and 54 and project outwardly of the floor 20 to define a gap 134 therebetween.

Front endwall 12 also includes stacking lugs 52 and 54 extending at a normally upwardly inclined angle with respect to the normal horizontal orientation of basket 10. Thus, stacking lugs 52 and 54 elevated with respect to cornice 28 and the remainder of sidewall 12. On the other hand, stacking lugs 52 and 54 are lower in elevation than rims 56 and 58 extending along right sidewall 18 and left sidewall 16 respectively.

Turning now to FIG. 5, rear endwall 14 also includes a cornice 60 having a width the same as cornice 28. The widths of cornice 28 and cornice 60 are complimental to recesses 48 and 50 in front wall and also recesses 62 and 64 defined between registry leg 40 and base 66 and registry leg 42 and base 68 respectively. As may be seen in FIGS. 4 and 5, and also in FIGS. 2 and 3, base 66 and base 68 depend downwardly from floor 20, whereby base 66 and base 68 extend beneath all other portions of basket 10. Thus, when placed on a substantially planar, horizontal surface, basket 10 is supported exclusively by base 66 and base 68.

Sidewalls 16 and 18 each include a plurality of spaced-apart stacking posts 70. Each of the stacking posts is of a constant width and height, to present a plurality of equally spaced breaches 72 therebetween. Each of these breaches 72 is of somewhat greater width than the width of stacking posts 70, the width of each breach corresponding to the width of corresponding nesting ledge 74 located immediately thereabove. Each of the stacking posts 70 are interconnected by sidewalls 16 or 18 including nesting ledges 74 and rim 56 or rim 58.

Stacking posts 70 include stacking platform 76 and stacking feet 78 extending downwardly from stacking post 70. Stacking feet 78 are thus of a width to fit complimentarily between stacking post 70 on nesting ledge 74 when the basket 10 is placed on a similar basket at a nested elevation. In addition, stacking platform 76 corresponds substantially in width to stacking feet 78 whereby stacking feet 78 may rest upon a stacking platform 76 of a similarly configured basket. A space 79 is thus defined between stacking foot 78 and base 66 or base 68.

In order to retain the stacking feet 78 in position on a stacking platform 76 of a similarly configured basket, basket 10 hereof includes a stacking lip 80 extending normally upwardly adjacent stacking platform 76 on each of stacking posts 70. The stacking lip 80 of a lower, similar basket is thus adapted to fit within space 79 of an upper basket 10.

However, on stacking post 70 of each sidewall 16 and 18, a modified stacking lip 82 is provided which includes an alignment notch 84 defined therein. Alignment notch 84 is configured to receive an alignment web 86 extending transversly between stacking foot 78 and base 66 or base 68, as shown in FIG. 5. Alignment web 86 of a similarly configured basket would then register with an alignment notch 84 when a similarly configured basket having alignment webs 86 are positioned over basket 10 in a stacked orientation. When the baskets are positioned in a nesting orientation, the alignment web 86 will alternately register in nesting notch 88, visible in FIG. 6.

Figure 6:
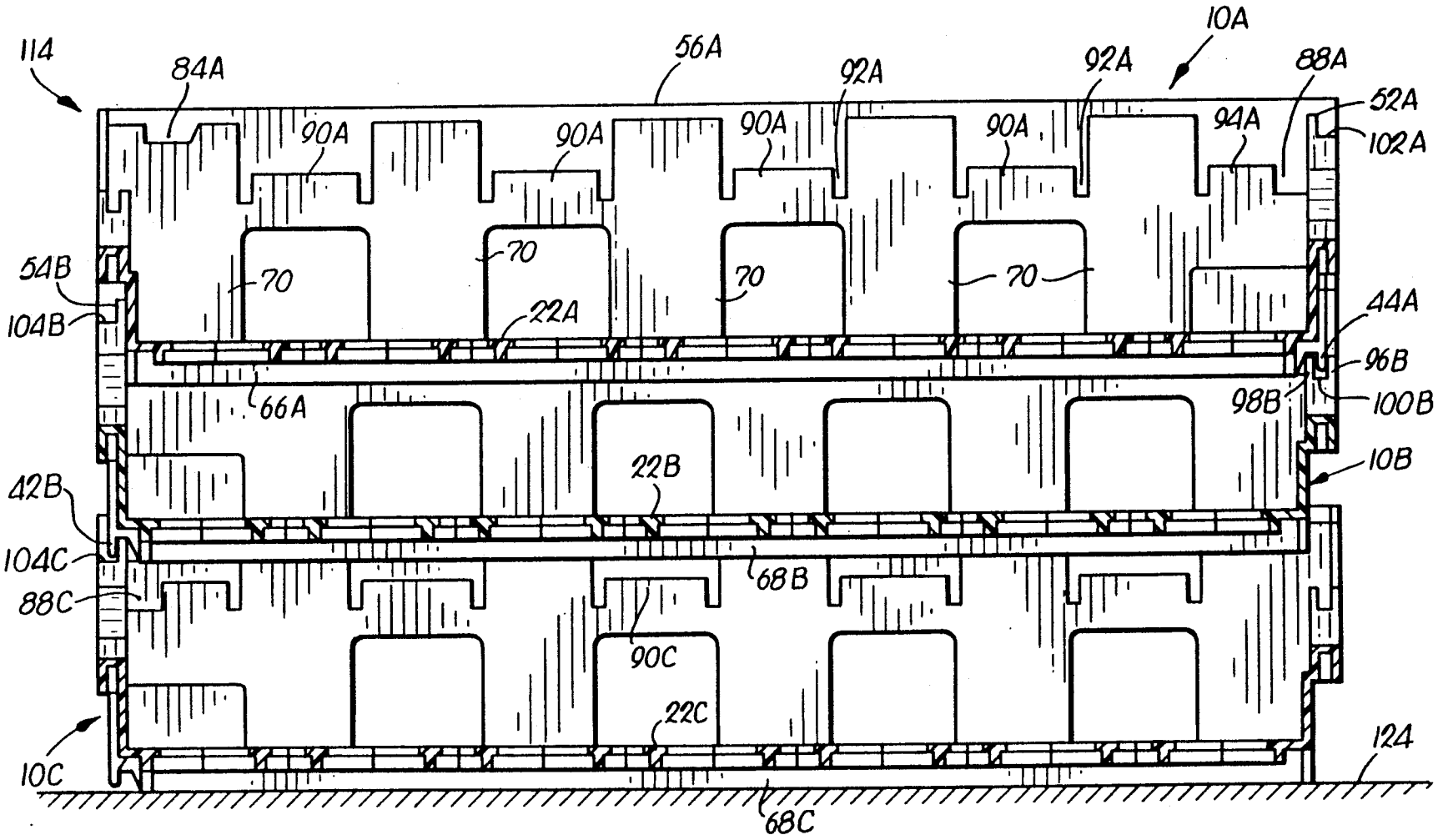
FIG. 6 is a cross-sectional view of three similar multi-level baskets of the present invention in superposed relationship, the middle basket being shown in stacked orientation at an upper height relative to the lower basket, the upper basket being shown oriented in a nested, lower orientation with respect to the middle basket.

Also, as seen in FIGS. 1 and 6, a nesting lip 90 is provided adjacent each nesting ledge 74 for positioning in space 79 and retaining the stacking feet 78 of a similarly configured basket when the similarly configured basket is positioned on the basket 10 hereof in a nested orientation. The nesting lips 90 extend only a portion of the distance between adjacent stacking posts 70 in order to provide drainage slots 92 for preventing water from collecting on nesting ledge 74 behind nesting lip 90. Modified nesting lip 94 is shortened relative to nesting lips 90 in order to provide nesting notch 88.

Additionally, rear endwall 14 includes a retaining buttress 96, a nesting wall 98 and a nesting shelf 100 adjacent both sidewalls 16 and 18 for receiving stacking toes 44 and 46 of a similarly configured basket when a similarly configured basket is mounted in a nesting orientation on basket 10. Alternately, when a similarly configured basket is rotated 180 degrees into a stacking orientation, stacking toes 44 and 46 are positioned to rest on stacking shelves 102 and 104 adjacent stacking lugs 52 and 54 respectively. The stacking shelves 102 and 104 serve to aid in supporting similarly configured basket and are positioned at the same elevation as stacking platforms 76.

Rear endwall 14 includes inboard portions 106 and 108 which are recessed relative to the remainder of rear endwall 14 such that when basket 10 is positioned in a nested orientation on a similarly configured basket, inboard portion 106 and inboard portion 108 are located interior to and abutting outboard portions 110 and 112, respectively, of the front endwall 12 of a similarly configured basket, as best seen in FIG. 4.

In use, the stacking and nesting capabilities of the basket 10 hereof may best be illustrated by similar baskets 10A, 10B, and 10C as shown in FIG. 6. When combined in superposed position, two or more baskets 10A, 10B and 10C are conventionally referred to as a stack 114. FIG. 6 illustrates such a stack 114 when an upper basket 10A is mounted on an intermediate basket 10B in a nested orientation, while basket 10B is mounted on a lowermost basket 10C in a stacked orientation. The letters "A", "B" and "C" correspond to the particular components of the respective baskets 10A, 10B and 10C.

With respect to the combination of baskets 10A and 10B, basket 10A is similarly configured to basket 10B and thus is provided with base 66 and base 68, base 68 being visible in the sectional view shown in FIG. 6. In such an orientation, stacking toes 66 of basket 10A is positioned over a nesting shelf 100 of basket 10B and between buttress 96 and nesting wall 98. Base 68A, extending beneath the remainder of basket 10A, obscures from view the positioning of stacking feet 78A on nesting ledge 74B behind nesting lip 90B. Thus, in the nested orientation, basket 10A is supported on basket 10B by stacking toes 44A and 46A located within nesting shelf 100B and stacking feet 78A positioned on nesting ledge 74B. Further, as additional support, shoulders 116A, 118A, 120A and 122A are configured to rest on or immediately adjacent rim 56B of basket 10B, thus furnishing additonal support.

Basket 10B sits in a stacked orientation with respect to basket 10C. In this orientation, stacking toe 46B is oriented over stacking shelf 104C with stacking feet 78B obscured by base 68B. However, stacking feet 78B rests on or over stacking platforms 76C in order to support basket 10B in a stacked orientation (and thus at a higher elevation than when in a nested orientation) on basket 10C. In this stacked orientation, alignment web 86B is located within alignment notch 84C of basket 10C. Finally, as may be seen in FIG. 6, base 68C supports the entire stack 114, protecting the various stacking feet, stacking lugs, stacking toes and the like from damage or wear in the event the stack were to be skidded or moved across a supporting surface. Thus, when supporting surface 124 is a substantially planar, horizontally extending surface, base 68C and base 66C serve to support the entire stack and no other components of the stack engage the surface 124.

Figure 7:
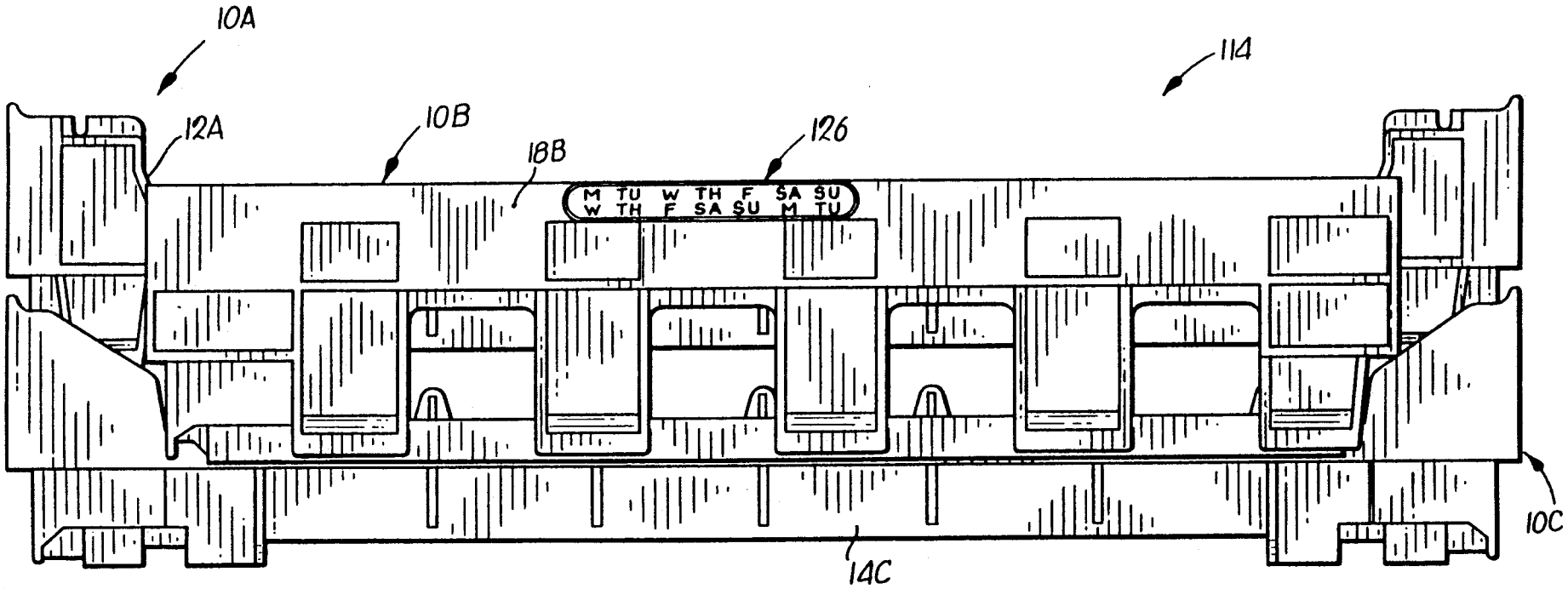
FIG. 7 is an elevation view of the three multi-level baskets shown in FIG. 6, the multi-level baskets being oriented at 90 degree angles into a storage orientation.

However, it may be desirable to orient the baskets into a storage orientation, best seen in FIG. 7. As may be seen in FIG. 7, the total height of stack 114 may be substantially reduced by orienting the superposed baskets 10A, 10B and 10C at 90 degree angles to one another. In FIG. 7, basket 10A is presented with front endwall 12A facing forward, the next lowermost basket 10B with left sidewall 18B facing forward and lowermost basket 10C positioned with rear endwall 14C facing forward. In such orientations, cornice 28 and cornice 60 of each basket are adapted to fit within recesses 48, 50, 62 and 64 of the next uppermost basket. The next uppermost basket is thereby prevented from transverse shifting, while buttresses 96 and inboard portions 110 and 112 prevent longitudinal movement of the next uppermost basket 10. Yet further resistance to longitudinal or transverse shifting is provided by the placement of teeth 26 and openings 24 whereby teeth 26 are selectively spaced to fit within openings 24 and thus serve as a further safeguard against undesired shifting of baskets 10 within the stack 114.

Finally, the baskets hereof are advantageously provided with an age indicator 126 whereby users of the baskets may readily discern the useful life of the baked products therein. Age indicator 126 is advantageously includes a plurality of raised integrally formed indicia 128, each indicia 128 corresponding to a different day of the week.

Figure 2:
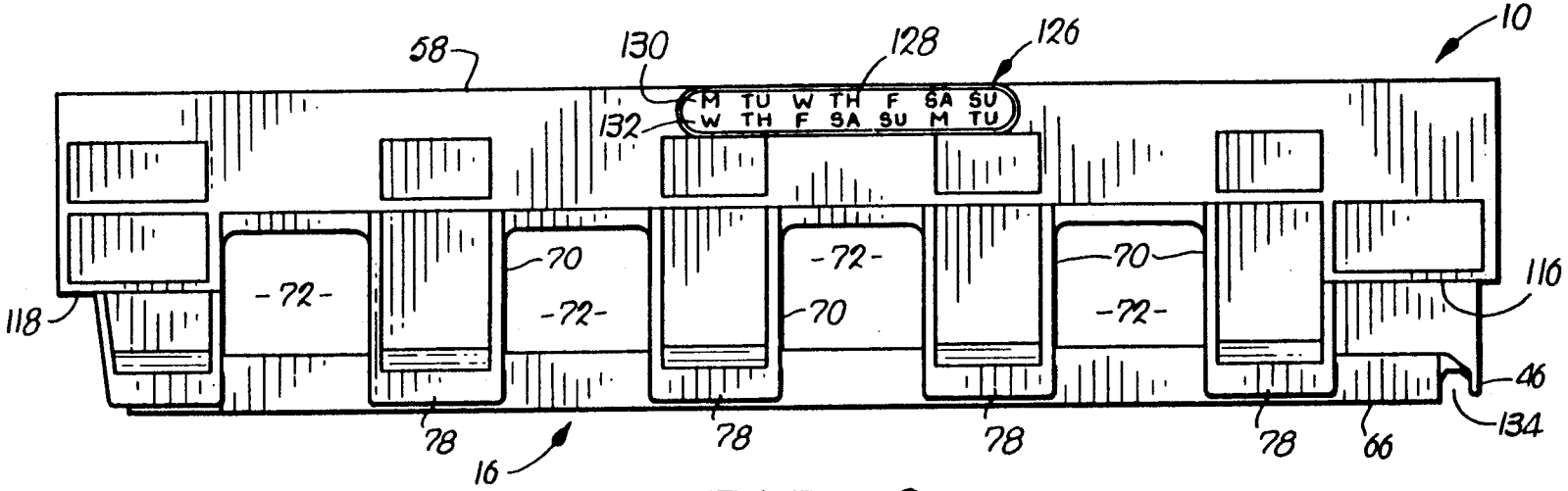
FIG. 2 is a left side elevational view of the multi-level basket shown in FIG. 1.
Figure 3:
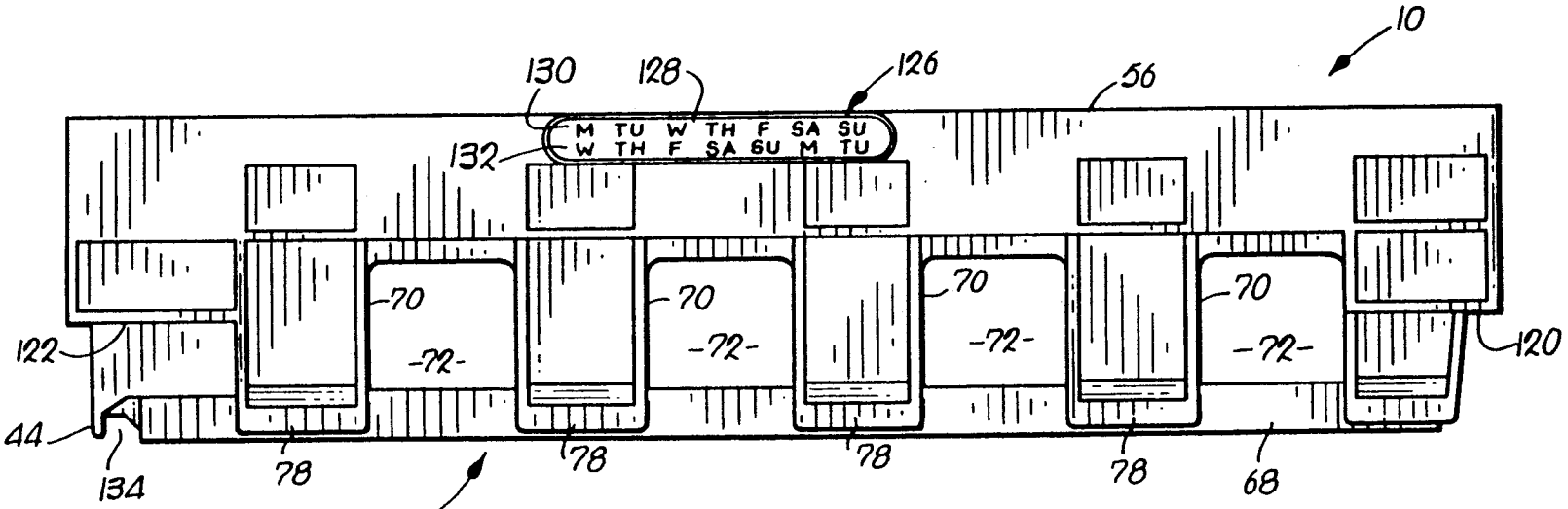
FIG. 3 is a right side elevation view of the multi-level basket of FIG. 1.

As shown in FIGS. 2 and 3, the indicia 128 include letters corresponding to the various days of the week arranged in a first row 130 and a second row 132. The rows are arranged so that the individual indicia are in registry, although it is desirable that the second row of indicia 132 be formed out of sequence with the first row indicia 130. This for the reason that the first row of indicia may be used to indicate the date of delivery of the baked goods contained within the basket 10, while the second row of indicia 132 corresponds to the expiration date of such baked goods. A deliveryman may use a piece of chalk to strike, in a single stroke, indicia corresponding to both the date of delivery and the date of expiration. The user of the baked products within the basket may thus instantly discern when the baked goods were delivered and when their useful life expires, ensuring that only fresh product will be dispensed from the baskets hereof. In the event the product remains within the basket beyond the date marked by the chalk mark (which in the present case would be a vertical chalk mark extending through indicia both the first and the second row corresponding to different days), the product remaining within the basket would be discarded as beyond its useful life.

Having thus disclosed the preferred embodiment of my invention, I claim:

1. A basket adapted for alternate high-elevation stacking, low-elevation nesting, and third elevation storage with a similarly configured basket comprising:

a substantially rectangular, normally horizontally oriented floor;

a normally upright front end wall integrally formed with said floor;

a normally upright rear end wall integrally formed with said floor and opposed to said front end wall; and a pair of opposed, normally upright sidewalls, each of said sidewalls comprising:

an upper rim extending along said side wall, a plurality of normally upright, spaced-apart stacking posts of substantially uniform width and height interconnected by said rim, each of said stacking posts including a stacking platform and a stacking lip projecting normally upwardly therefrom, a stacking foot projecting downwardly from each of said stacking posts and formed integrally therewith, each of said stacking feet positioned outwardly of said floor to present a space therebetween, a plurality of nesting ledges each of said ledges being located adjacent to a respective one of said stacking posts, said nesting ledges being of complimentary width to said stacking feet for supporting the stacking feet of said similarly configured basket thereon, each of said nesting ledges, having a normally upright nesting lip for resisting side to side movement of the stacking feet of said similarly configured basket when the stacking feet of the similarly configured basket are supported by said nesting ledges, said nesting lips being oriented for positioning within the space between the stacking feet and floor of the similarly configured basket, said upper rim extending normally upwardly of said stacking lips, said front end wall including a stacking lug projecting upwardly from a stacking shelf adjacent each of said side walls, and a stacking toe oriented normally below said stacking lug and projecting outwardly of said floor to present a gap therebetween, said stacking toe being located for receiving the stacking lug of the similarly configured basket in said gap to limit relatively front-to-rear movement between said basket and the similarly configured basket when said basket is stacked in superposed relationship to the similarly configured basket with the stacking toe of said basket positioned on a stacking shelf of the similarly configured basket, said nesting lips being oriented to define a drainage slot between said nesting lips and an adjacent stacking post for draining accumulated liquid from said nesting ledge.

2. A basket adapted for alternate high-elevation stacking, low-elevation nesting, and third elevation storage with a similarly configured basket comprising:

a substantially rectangular, normally horizontally oriented floor;

a normally front end wall integrally formed with said floor;

a normally upright rear end wall integrally formed with said floor and opposed to said front end wall; and a pair of opposed, normally upright sidewalls, each of said sidewalls comprising:

an upper rim extending along said side wall, a plurality of normally upright, spaced-apart stacking posts of substantially uniform width and height interconnected by said rim, each of said stacking posts including a stacking platform and a stacking lip projecting normally upwardly therefrom, a stacking foot projecting downwardly from each of said stacking posts and formed integrally therewith, each of said stacking feet positioned outwardly of said floor to present a space therebetween, a plurality of nesting ledges each of said ledges being located adjacent to a respective one of said stacking posts, said nesting ledges being of complimentary width to said stacking feet for supporting the stacking feet of said similarly configured basket thereon, each of said nesting ledges, having a normally upright nesting lip for resisting side to side movement of the stacking feet of said similarly configured basket when the stacking feet of the similarly configured basket are supported by said nesting ledges, said nesting lips being oriented for positioning within the space between the stacking feet and floor of the similarly configured basket, said upper rim extending normally upwardly of said stacking lips, said front end wall including a stacking lug projecting upwardly from a stacking shelf adjacent each of said side walls, and a stacking toe oriented normally below said stacking lug and projecting outwardly of said floor to present a gap therebetween, said stacking toe being located for receiving the stacking lug of the similarly configured basket in said gap to limit relatively front-to-rear movement between said basket and the similarly configured basket when said basket is stacked in superposed relationship to the similarly configured basket with the stacking toe of said basket positioned on a stacking shelf of the similarly configured basket, at least one of said front end wall, rear end wall or side walls including a plurality of juxtaposed rows of integrally formed indicia, the indicia of each of said rows corresponding to different days of the week, the indicia of one of said rows being out of registry with corresponding indicia on an adjacent row.

* * * * *